US005533802A

United States Patent [19]

Garganese

[11] Patent Number: 5,533,802

[45] Date of Patent: Jul. 9, 1996

[54] PAINT CAN ACCESSORY

[76] Inventor: Richard S. Garganese, 40 Celestia Ct., North Kingstown, R.I. 02852

[21] Appl. No.: 398,672

[22] Filed: Mar. 6, 1995

[51] Int. Cl.[6] ..... B01F 7/16

[52] U.S. Cl. ..... 366/256; 366/605

[58] Field of Search ..... 366/605, 242, 366/255, 257, 259, 260, 267, 315; 220/295, 287, 305, 306, 315, 350

[56] References Cited

U.S. PATENT DOCUMENTS

| | | | |
|---|---|---|---|
| D. 341,318 | 11/1993 | Brown | D9/447 |
| 568,005 | 9/1896 | Stukes . | |
| 722,833 | 3/1903 | Furlong . | |
| 820,631 | 5/1906 | Eckart . | |
| 912,279 | 2/1909 | Brockette . | |
| 1,211,426 | 1/1917 | Farrington . | |
| 1,243,982 | 10/1917 | Rupp . | |
| 1,655,447 | 1/1928 | Wait . | |
| 2,207,335 | 7/1940 | Thomas et al. | 366/242 |
| 2,701,131 | 2/1955 | Love | 259/126 |
| 2,726,071 | 12/1955 | Bernhardt | 366/256 |
| 2,879,044 | 3/1959 | Gunas | 259/134 |
| 2,905,453 | 9/1959 | Wise | 259/134 |
| 3,140,078 | 7/1964 | Krahe et al. | 259/47 |
| 4,176,797 | 12/1979 | Kemp | 241/30 |
| 4,401,268 | 8/1983 | Pomponi, Jr. | 239/142 |
| 4,926,390 | 5/1990 | Murzsa | 366/605 |
| 4,964,527 | 10/1990 | Martin | 220/90 |
| 4,966,468 | 10/1990 | Bruning | 366/333 |
| 5,199,788 | 4/1993 | Stallings | 366/605 |
| 5,368,389 | 11/1994 | Dedoes | 366/605 |

*Primary Examiner*—Robert W. Jenkins
*Attorney, Agent, or Firm*—Barlow & Barlow, Ltd.

[57] ABSTRACT

An improved paint can accessory that permanently replaces an original paint can lid is provided. The accessory includes a main body with three apertures therein. The first aperture is circular and provides access by a siphon hose from paint spraying machines. A releasable plug closes the first aperture when not in use. A semicircular second aperture receives an insert having a pouring spout to permit controlled pouring of liquid contained in the container. A third aperture receives a mixing shaft which is connected to a mixing plate to mix liquid within the container. A handle facilitates actuation of the mixing shaft and, by its rotational position, ensures that the mixing plate is properly positioned. The accessory also completely covers the sealing groove of the paint can to prevent flow of liquid therein.

11 Claims, 3 Drawing Sheets

PAINT CAN ACCESSORY

BACKGROUND OF THE INVENTION

The present invention relates generally to a paint can accessory for affixation to a container. More specifically, the present invention relates to a paint can accessory for attachment to a standard paint can container during the entire length of use of the paint therein.

In the field of painting, it has been well known for manufacturers to distribute paint in a standard container that has a circumferencial sealing groove to receive the flange of a paint can lid. Both professional and casual painters face various problems associated with this paint can design which has been adopted throughout the painting industry.

One of the primary problems occurs during the extraction of paint from within the paint can. After a paint brush is inserted into the paint residing within the paint can, excess paint is typically wiped off on the inside edge of the can. Most of the paint drips back into the inside of the container; however, all too often paint also flows onto the top of the paint can into the sealing groove as well as over the edge of the paint can to drip down its exterior. Such external dripping wastes paint and makes the overall can very messy.

In addition to the foregoing problem, use of the standard paint can configuration makes it extremely difficult to thoroughly mix the paint therein. Typically, a wooden stick or the like is used to stir the paint prior to use. However, this known method of mixing suffers from the drawbacks of incomplete mixing, waste of paint, and unnecessary mess. Such problems persist because the stick must be wiped off and removed prior to use, or at least prior to replacing the paint can lid for storage. The wet mixing stick, which is often reused, must be carefully stored to avoid further undesired mess.

Common paint can arrangements also suffer from the ability to pour the paint in a neat and controlled way. Pouring from a paint can results in a flow of paint which is too wide for pouring into a smaller containers which is carried out quite often to avoid having to hold a heavy can during painting.

In recent years, painting machines have become increasingly popular which employ siphons to draw paint from a standard paint can. These painting machines often require a specialized lid for the standard paint can so that its siphon may be used. It is not desirable to simply siphon paint from an open paint can due to the possibility of splashing or spraying during application.

Various attempts in the prior art have been made to solve the inherent problems with the standard paint can. For example, to avoid flow of paint into the sealing groove, holes can be punched with a nail or the like into the floor of the groove to permit drainage back into the can. Also, the prior an includes lids which completely cover the sealing groove to prevent the paint from contacting the sealing groove. These prior art devices also include a structure on which a brush can be wiped to remove excess paint.

However, none of these prior art paint can accessories provide a complete solution for all of the shortcomings of using paint from a standard paint can. None of the prior art paint can accessories provide a lid which may reside on the top of the paint can until all the paint residing therein is depleted. Prior art devices must be installed on the paint can after the original lid has been removed. Between painting sessions, the prior art paint accessory must be removed to permit the original paint can lid to be reinstalled. At the next painting session, the original lid is again removed and the prior art paint can accessory is reinstalled. None of the prior art paint can accessories address, in one apparatus, the problems of flow into the sealing groove, need for a quality integrated mixer, access for siphons from paint machines, access for paint brushes directly to the paint, and a pouring spout for accurate pouring while providing a single structure which completely seals the paint can and does not have to be removed between uses and eliminates the need for replacing the original lid between uses.

Due to the demand for a paint can accessory which solves all of the problems associated with a standard paint can, it is desirable for a paint can accessory to include several integrated features in a single unit which effectively replaces the original paint can lid. It is also desirable to include, in a single accessory, multiple options in which to dispense and access the paint in the paint can.

SUMMARY OF THE INVENTION

The present invention preserves the advantages of prior art paint can accessories. In addition, it provides new advantages not found in currently available paint can accessories, and overcomes many disadvantages of such currently available paint can accessories.

The invention is generally directed to a novel and unique paint can accessory with particular application in completely replacing the original paint can lid while providing a superior way of accessing and dispensing the paint in the paint can. The paint can accessory of the present invention enables the simple, easy and inexpensive replacement of the original inferior paint can lid while providing many solutions to troublesome problems associated with the standard paint can design.

The preferred embodiment of the present invention includes four primary members. A substantially circular main body is provided with a circumferencial trough in its underside and about its periphery. The trough is capable of sealingly engaging over a container sealing groove to prevent paint from flowing in the sealing groove. A resealable plug resides in a circular aperture which is positioned to receive a siphon from a paint machine. An insert is releasably engageable with a second aperture in the main body. The insert further includes a pouring spout therein to permit paint contained in the paint can to be poured therefrom in a controlled manner. A mixing shaft is slideably engaged with a third aperture. The mixing shaft has on its first end a circular agitator plate and on its second end, a handle.

When installed, the main body rests over the sealing groove of the paint can to protect the sealing groove from the flow of paint. The opening of the paint can is completely covered by the main body but can be opened in accordance with the desired way of dispensing new paint. The insert may be removed to permit a paint brush or the like to access the paint in the can. With the insert in place, a cap on the pouring spout may be removed to permit pouring therethrough. Further, the resealable plug may be removed to permit access by a siphon of a paint machine.

In operation, the paint can accessory of the present invention is installed over the top of the paint can to replace the original paint can lid. With a new can of paint, the handle of the mixer is aligned to ensure that the agitator plate is coaxial with the paint can itself. Upon actuation of the shaft by moving the handle up and down, the agitator plate also moves up and down to thoroughly mix the paint in the can.

It is therefore an object of the present invention to provide a paint can accessory that can completely replace the original paint can lid without requiring the original lid to be installed between uses.

Another object of the present invention is to provide a paint can accessory which solves all of the inherent problems associated with a standard paint can structure in a single apparatus.

It is a further object of the present invention to provide a paint can accessory that protects the sealing groove at the top of a standard paint can.

It is yet a further object of the present invention to provide a paint can accessory that permits closeable access to the paint in a paint can by a siphon of a paint machine.

It is another object of the present invention to provide a paint can accessory with an integrated paint mixer.

Another object of the present invention is to provide a closeable access with a brush wiping edge to remove excess paint from a brush.

It yet a further object of the present invention to provide a paint can accessory with a closeable pouring spout.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
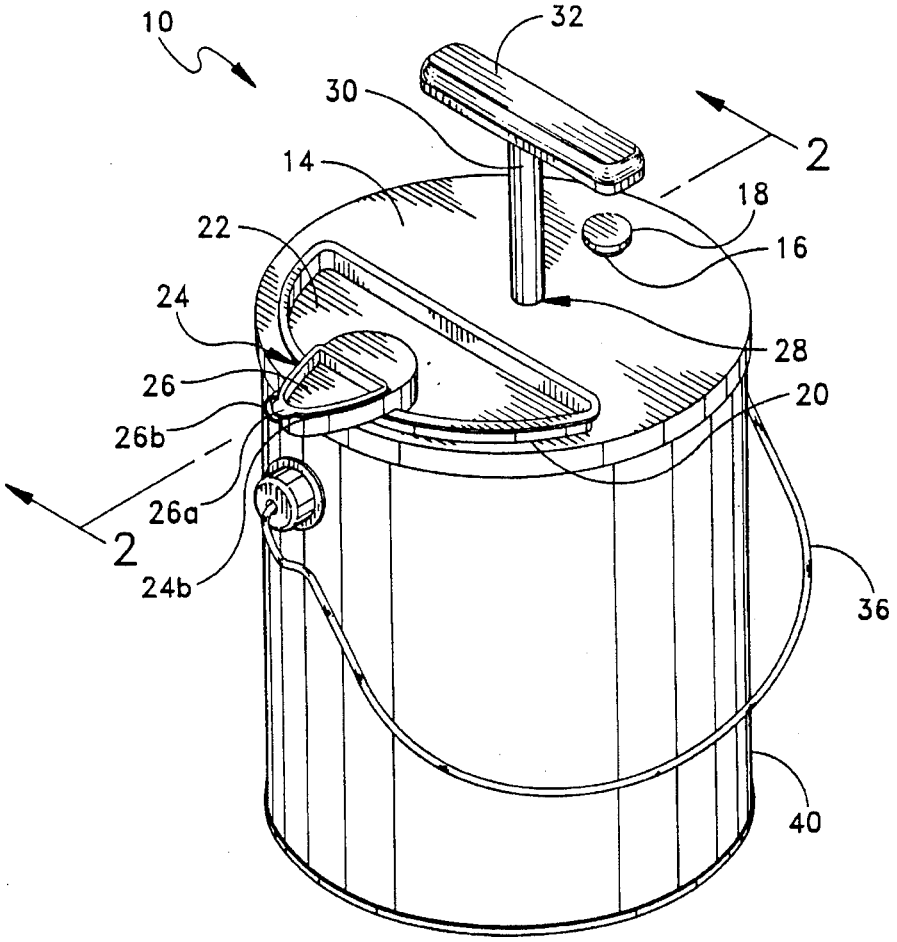
FIG. 1 is a perspective view of the paint can accessory of the present invention installed on a standard paint can.

Referring to FIG. 1, a perspective view of the paint can accessory of the present invention installed on a standard paint can is shown. The standard paint can 40 is shown to include a handle 36 and a top opening for receiving a lid (not shown). The paint can accessory 10 of the present invention includes a main body 14 with a number of apertures therein. Circular first aperture 16 houses releasable plug 18. Semicircular second aperture 20 receives and houses insert 22. Incorporated into insert 22 is pouring spout 24. A spout cap 26 resides in cap seat **24*b* in pouring spout 24. A tab 26*a* is provided on the cap for ease of removal from cap seat 24*b*. A cap connector 26*b* is also provided to prevent spout cap 26** from being misplaced.

Circular third aperture 28 is provided through main body 14 and off of its center. A mixing shaft 30 slideably resides in circular third aperture 28. Handle 32 is affixed to the upper end of mixing shaft 30 to facilitate the actuation of mixing shaft 30 within circular third aperture 28. As will be discussed in detail below, a mixing plate is provided on the lower end of the mixing shaft to effectuate mixing of the liquid within container 40.

Figure 2:
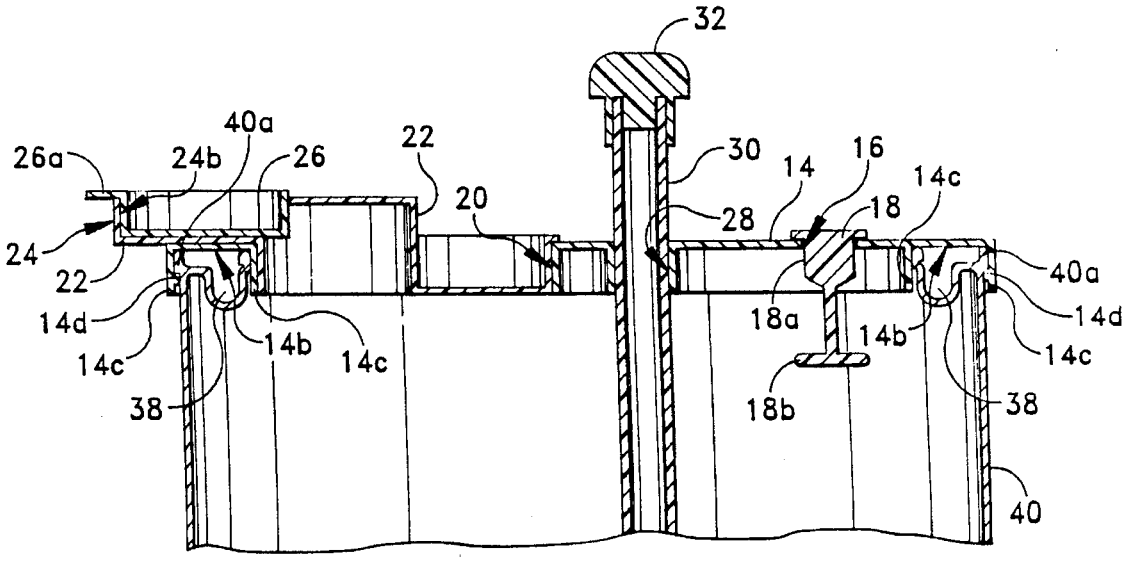
FIG. 2 is a partial cross-sectional view through the line 2—2 of FIG. 1.

Turning now to FIG. 2, a cross-sectional view through the line 2—2 of FIG. 1 is shown. Standard paint can container 40 includes a circumferential sealing groove 38 at its upper mouth opening. Main body 14, with insert 22 therein, completely covers and encloses container 40. In particular, main body 14 includes an inverted trough **14*b* with a ridge 14*d* for engaging lip 40*a* on the outside of container 40. As a result, trough 14*b* substantially mates with the portion of container 40 which forms sealing groove 38. As a result, main body 14, after being installed to the top portion of container 40, completely covers and protects sealing groove 38 from the flow and exposure to any liquid. Circular first aperture 16 grippingly engages the sealing neck portion 18*a* of releasable plug 18. Affixed to the bottom of releasable plug 18 is a retaining member 18*b* which prevents the releasable plug from being misplaced should it become unintentionally jarred loose. When circular first aperture 16 is desired to be used as an access port, releasable plug 18** is completely removed.

Semicircular second aperture 20 houses and retains insert 22. Integral with insert 22 is a pouring spout 24 with a cap seat **24*b* for receiving and retaining spout cap 26. As shown in FIG. 1, spout cap 26 further includes a tab 26*a* to facilitate unseating of the spout cap 26 from cap seat 24*b***.

Circular third aperture 28 receives mixing shaft 30 therethrough. The mixing shaft 30 and circular third aperture 28 form a snug mate; however, mixing shaft 30 may still easily actuate within circular third aperture 28. In addition, handle 32 resides on the top end of mixing shaft 30 for ease and control of the mixing shaft 30.

Figure 3:
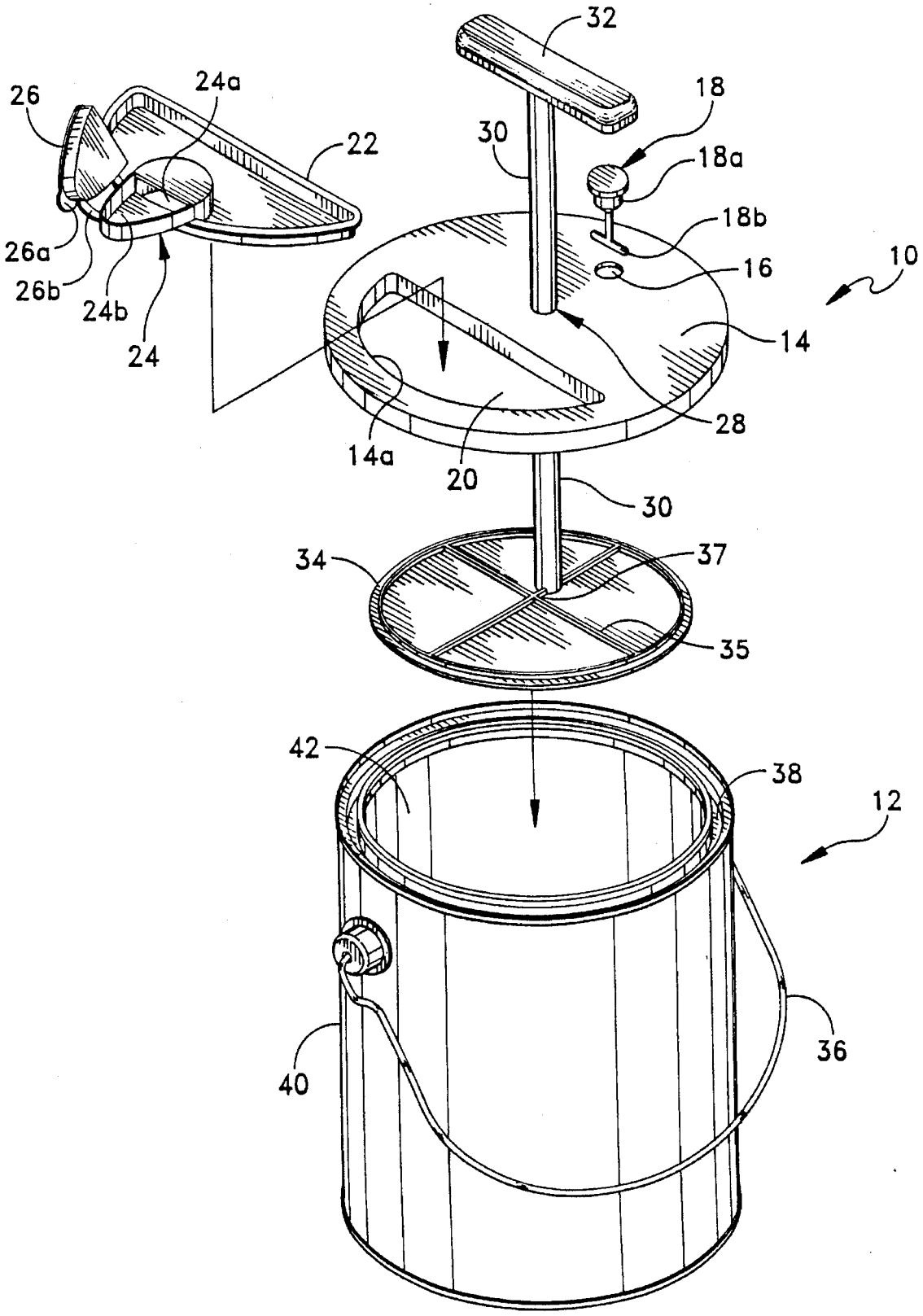
FIG. 3 is an exploded perspective view of the paint can accessory of the present invention in conjunction with a standard paint can.

Turning now to FIG. 3, an exploded view of the paint can accessory of the present invention is shown. FIG. 3 illustrates the present invention with spout cap 26 unseated from cap seat **24*b* to expose pouring spout aperture 24*a* through which liquid may flow when the insert 22 is installed within semicircular second aperture 20. When main body 14 is installed over sealing groove 38, insert 22 may be removed to fully expose semicircular second aperture 20 to permit easy direct access to the liquid within container 40. The employment of the accessory of the present invention without insert 22 installed is particularly well-suited for extracting paint directly from container 40 by use of a paint brush or the like. Semicircular second aperture 20 is large enough to permit access by brushes of sizes ranging from small to very large. Semicircular surface 14*a* on main body 14 provides a brush wiping edge to wipe off excess paint from a brush which is extracting paint from container 40. Semicircular second aperture 20 is preferably large which requires the location of circular third aperture 28, which receives mixing shaft 30, to be off of center through main body 14. FIG. 3 further illustrates the employment of mixing plate 34 which is affixed to the bottom end of mixing shaft 30. As can be seen, mixing plate 34 is preferably solid and reinforced with optional reinforcing ribs 35. As can be seen, mixing shaft 30 connects to mixing plate 34 off the center 37 of mixing plate 34. Since circular third aperture 28 is off center, connection to mixing plate 34 of mixing shaft 30 must also be off center to ensure that mixing plate 34 is coaxial with container 40. As will be discussed below, providing mixing plate 34 in a coaxial position relative to container 40 results in superior mixing of the liquid residing within container 40. In addition, the rotational positioning of handle 32 is aligned with the proper rotation of mixing plate 34 to ensure that mixing plate 34 is coaxial with container 40. The rotational position of handle 32 may be used to indicate whether mixing plate 34 is properly positioned within container 40. For example, handle 32 may be affixed at a position parallel with the straight edge of semicircular second aperture 20 to indicate that mixing plate 34** is properly rotationally positioned.

Figure 4:
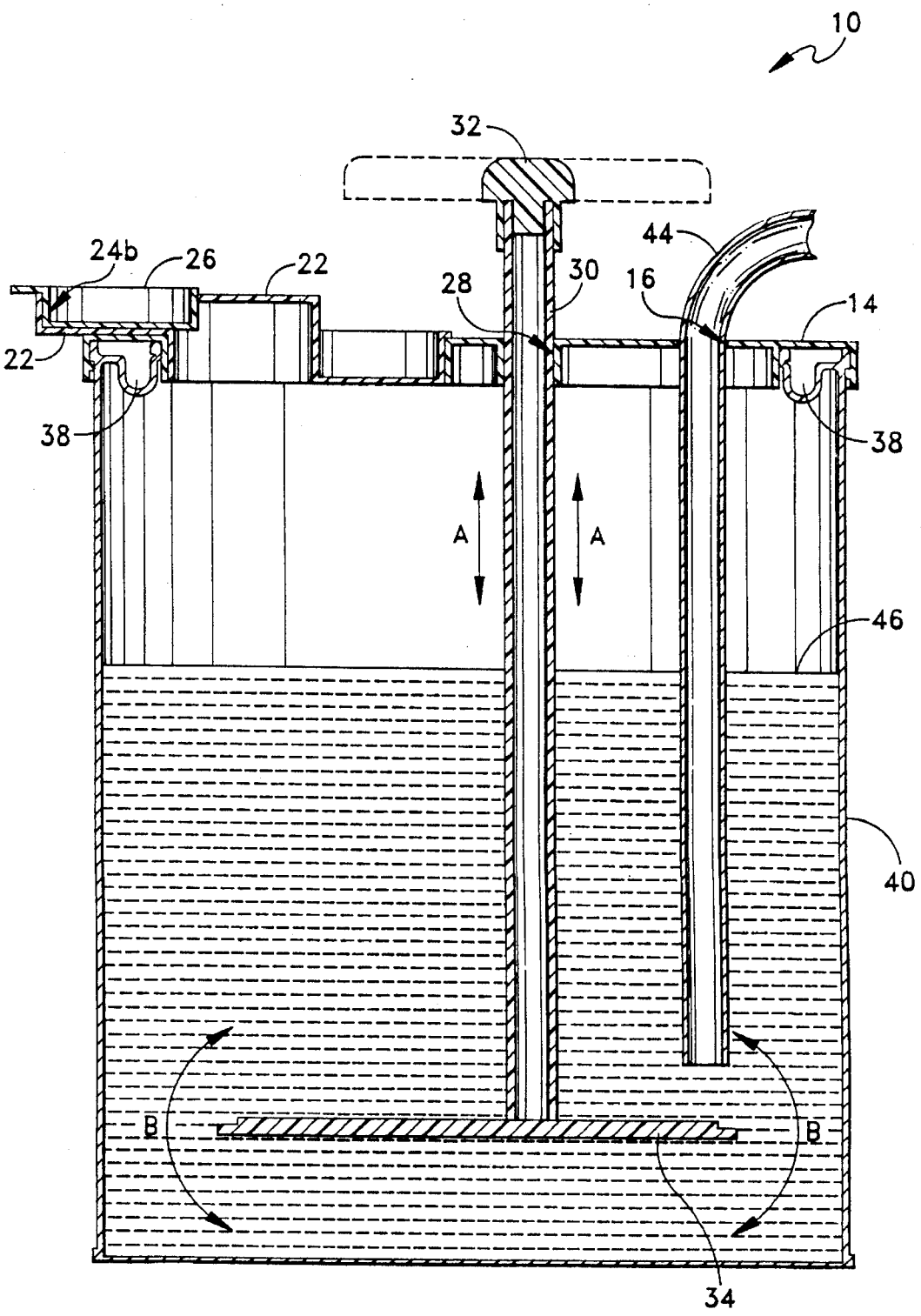
FIG. 4 is a cross-sectional view through the line 2—2 of FIG. 1 with paint inside the paint can and a siphon installed.

The use of the paint can accessory of the present invention is shown in FIG. 4. Liquid material 46, such as paint, resides within paint can container 40. After the original paint lid of paint can 40 is removed (not shown), paint can accessory 10 of the present invention may be installed onto the top open portion of paint can 40. When installed, sealing groove 38 is protected under main body 14. Mixing shaft 30 is permitted to slide through circular third aperture 28 through main body 14 as indicated by arrows A. Connected to the bottom of mixing shaft 30 is mixing plate 34 which is positioned concentric and coaxial to paint can 40. As mixing plate 34 actuates up and down, liquid 46 is thoroughly mixed. As indicated by arrows B, the flow of paint on a downward stroke causes the paint to go upward and over onto the top of mixing plate 34. On an upstroke, liquid 46 is pulled upward and, as a result, flows downward between mixing plate 34 and container 40. As mixing plate 34 moves upward, a vacuum is created thereunder to help pull the liquid 46 under mixing plate 34. Due to the employment of a solid circular mixing plate 34 within a cylindrical container 40, superior mixing can be achieved after only a short period of time. After the paint is mixed, mixing plate 34 remains immersed in liquid 46 in a completely downward position.

The paint can accessory of the present invention also accommodates the siphon hose of paint machines and paint sprayers. These machines need a paint source from which to draw its supply. Releasable plug 18, as shown in FIGS. 1–3, is removed completely from circular first aperture 16. Siphon hose 44 from a paint sprayer machine is inserted therein to access liquid 46. When access through circular first aperture 16 is no longer needed, releasable plug 18 may be reinstalled.

The paint can accessory 10 of the present invention also provides controlled pouring of liquid 46 from container 40. Spout cap 26 is unseated from cap seat 24 to expose pouring spout aperture 24, as best seen in FIG. 3. When container 40 is tilted in the direction of pouring spout 24, liquid 46 will flow through pouring spout aperture 24*a* in a controlled fashion. When pouring is complete, spout cap is reinstalled on cap seat 24*b*.

The paint can accessory 10 of the present invention is preferably made of injection molded plastic but may be made of other materials. Various components may be made of different materials. For example, while it is preferred that the entire accessory and all its parts be made of plastic, the main body 14 may be made of plastic, while mixing shaft 30, mixing plate 34 and handle 32 be made of aluminum. Further, it is also possible that releasable plug 18 be made of a rubber material. Similarly, it is possible that insert 22 be made of a rubber of metal material.

It would be appreciated by those skilled in the art that various changes and modifications can be made to the illustrated embodiments without departing from the spirit of the present invention. All such modifications and changes are intended to be covered by the appended claims.

What is claimed is:

1. A multi-purpose accessory used with a container for protecting a container sealing groove, mixing liquid in said container, replacing an original container lid, permitting access to liquid in the container, pouring liquid from the container, said accessory comprising:

a substantially circular main body having a first aperture, a second aperture, a third aperture, and a circumferential trough in its underside and about its periphery; said trough being capable of sealingly covering a container sealing groove;

a resealable plug engageable with said first aperture;

an insert releasably engageable with said second aperture; said insert having a pouring spout therein;

a cap releasably engageable with said pouring spout;

a mixing shaft slidably engaged with said third aperture; said mixing shaft having a first end positioned above said main body and a second end positioned below said main body;

an agitator plate affixed to said first end;

a handle affixed to said second end; and whereby said handle is actuated up and down to slide said shaft within said third aperture to actuate said agitator plate up and down to mix liquid in a container upon which the multipurpose accessory is affixed.

2. The accessory of claim 1, wherein said first aperture is capable of receiving a siphon hose for extraction of liquid through said main body.

3. The accessory of claim 2, wherein said insert is substantially semicircular in shape and capable of sealing engagement with said second aperture.

4. The accessory of claim 1, wherein said second aperture is semicircular in shape and capable of receiving a brush for access to liquid and providing a brush wiping edge.

5. The accessory of claim 1, wherein said shaft is tubular.

6. The accessory of claim 1, wherein said agitator plate is solid.

7. The accessory of claim 1, wherein said agitator plate is circular.

8. A multi-purpose accessory used with a container for protecting a container sealing groove, mixing liquid in said container, replacing an original container lid, permitting access to liquid in the container, pouring liquid from the container, said accessory comprising:

a substantially circular main body having a first aperture, a second aperture, a third aperture, and a circumferential trough in its underside and about its periphery; said trough being capable of sealingly covering a container sealing groove;

a resealable plug engageable with said first aperture; with said resealable plug removed, said first aperture being capable of receiving a siphon hose for extraction of liquid through said main body;

an insert releasably engageable with said second aperture; said insert having a pouring spout therein; said second aperture being semicircular and said insert being substantially semicircular and matable therewith; said second aperture being capable of receiving a brush for access to liquid and providing a brush wiping edge;

a cap releasably engageable with said pouring spout;

a tubular mixing shaft slidably engageable with said third aperture; said mixing shaft having a first end positioned above said main body and a second end positioned below said main body;

a solid circular agitator plate affixed to said first end; said agitator plate being circular;

a handle affixed to said second end; and whereby said handle is actuated up and down to slide said shaft within said third aperture to actuate said agitator plate up and down to mix liquid in a container upon which the multipurpose accessory is affixed.

9. The accessory as claimed in claim 8, wherein said accessory is manufactured of plastic.

10. An improved liquid container assembly, comprising:

a cylindrical container having an opening and a circumferential lip about said opening with a sealing groove therein;

a circular main body, having a circumferential trough, attached to said cylindrical container to sealingly close said opening; said circumferential lip residing completely within said trough to cover said sealing groove;

a resealable plug positioned within a first circular aperture in said main body; said resealable plug permitting access to material contained in said cylindrical container by a siphon tube;

a semicircular insert sealingly positioned within a semicircular shaped second aperture in said main body; said insert including a pouring spout to permit material contained in said container to be poured therethrough; said semicircular shaped second aperture permitting access by brushes when said insert is not residing in said second aperture;

a releasable cap sealingly positioned within said pouring spout;

a tubular shaft slidably engaged with a third aperture in said main body; said tubular shaft having a first end positioned within said container and a second end positioned outside said container; said tubular shaft being positioned non-coaxially with said cylinder in said main body;

a solid circular agitator plate connected to said first end of said tubular shaft; said tubular shaft being connected off-center on said solid circular agitator plate;

a handle, having a rotational position, affixed to said second end of said tubular shaft; said rotational position of said handle indicating when said solid circular agitator plate is coaxial with said cylindrical container to ensure efficient mixing of material in said cylindrical container; and whereby vertical movement of said handle actuates said tubular shaft in and out of said third aperture in said main body thereby actuating said agitator plate to mix material contained in said cylindrical container.

11. The improved liquid container assembly of claim 10, wherein said main body, said releasable plug, said semicircular insert, said releasable cap, said tubular shaft, said solid agitator plate, and said handle are manufactured of plastic.

* * * * *